United States Patent [19]

Jarrett et al.

[11] Patent Number: 4,576,289

[45] Date of Patent: Mar. 18, 1986

[54] METHOD AND APPARATUS FOR RECYCLING CANS

[75] Inventors: Steve A. Jarrett; John F. Krzyston, both of Chesterfield County, Va.

[73] Assignee: Reynolds Metals Company, Richmond, Va.

[21] Appl. No.: 554,565

[22] Filed: Nov. 23, 1983

[51] Int. Cl.[4] ..... B07C 9/00; G07F 7/06

[52] U.S. Cl. ..... 209/631; 100/902; 194/213; 209/635; 209/930

[58] Field of Search ..... 209/631, 635, 644, 696, 209/707, 930; 100/902; 194/4 R, 4 C; 241/99

[56] References Cited

U.S. PATENT DOCUMENTS

| | | | |
|---|---|---|---|
| 1,290,895 | 1/1919 | Bryan . | |
| 1,987,640 | 1/1935 | Rothgarn | 209/930 X |
| 3,749,240 | 7/1973 | Spears et al. | 209/631 |
| 4,179,018 | 12/1979 | Miller | 194/4 R |
| 4,207,177 | 6/1980 | Block | 209/930 X |
| 4,285,426 | 8/1981 | Cahill | 194/4 C |
| 4,463,844 | 8/1984 | Huffman et al. | 194/4 C |
| 4,480,737 | 11/1984 | Jamgochian et al. | 194/4 C |
| 4,505,370 | 3/1985 | Swenck | 209/930 X |

FOREIGN PATENT DOCUMENTS

| | | | |
|---|---|---|---|
| 0908808 | 4/1954 | Fed. Rep. of Germany | 209/635 |

*Primary Examiner*—Robert B. Reeves
*Assistant Examiner*—Edward M. Wacyra
*Attorney, Agent, or Firm*—Alan T. McDonald

[57] ABSTRACT

A method and apparatus for recycling cans is disclosed. After separating magnetic material from the material input and separating conductive material from the remainder of the material input, overweight magnetic and/or conductive material is removed. The remaining metallic portions are then recombined for storage.

17 Claims, 5 Drawing Figures

METHOD AND APPARATUS FOR RECYCLING CANS

BACKGROUND OF THE INVENTION

Recycling of used products for reclamation of raw materials has become a way of life. Specifically, recycling of aluminum cans for reclamation of the aluminum is now commonplace.

Typically, a consumer saves a plurality of containers and brings these containers to a mobile or permanent recycling facility, where the containers are turned over to an employee of the recycling company who weighs or counts the containers and pays the consumer for the containers at a prestated rate. Unfortunately, such a system is labor intensive, requiring at least one operator to be at each facility whenever it is open.

One possible solution to the labor problem is to replace many of the manned stations with automated facilities. This, however, results in other problems.

If the ideal were reached, i.e., a customer places only aluminum cans into such a "reverse vending" machine, such a machine would be simple. All that would be necessary would be a means for weighing or counting the cans, a payout apparatus linked to the weighing or counting means and a means for storing the cans collected. However, such an ideal is never realized.

First, all beverage containers are not aluminum. Thus, a reverse vending machine must be capable of distinguishing steel from aluminum, so that no payment is made for steel cans.

While the placing of steel cans in a reverse vending machine designed to accept aluminum cans could be inadvertent on the part of the consumer, other deliberate acts must also be overcome by such a machine. It is not unknown for unscrupulous consumers to place bottles, rocks, sticks and other debris into reverse vending machines. Thus, the machine must be able to separate aluminum cans from this debris, handle the debris without damage to the machine and pay only for the aluminum cans. Additionally, other consumers, looking to cheat the machine, will place sand, rocks, water, and other materials into aluminum cans, hoping to be paid for the weight of the filled can. Or, a customer, not knowing the damage that a relatively large solid block of aluminum can do to a can crusher, may place portions of aluminum engine blocks, baseball bats and other massive aluminum materials into the reverse vending machine. Thus, in order to protect itself, as well as to avoid payment for weighted cans, the machine must be capable of discriminating between aluminum bodies based upon their weight.

Further, according to the process described in U.S. application Ser. No. 459,826, filed Jan. 21, 1983, the steel initially separated from the machine input may be recombined with the aluminum in the can crusher, after the aluminum has been weighed. The same problems of damage to the can crusher due to massive steel materials may thus result.

It is thus a primary object of the present invention to provide a method and apparatus for eliminating overweight metallic materials from the steel and/or aluminum material flow streams in a reverse vending machine.

THE PRESENT INVENTION

By means of the present invention, these desired objectives are obtained.

The reverse vending machine of the present invention includes a method and apparatus for discriminating between acceptable weight metallic materials and overweight material in a material flow stream. The metallic material, whether steel removed from the initial material input or aluminum from a later separation procedure within the reverse vending machine, is passed to an inclined chute positioned at a first angle with respect to the horizontal. Air is blown into the chute at a second angle with respect to the horizontal which is less than the angle of the chute. This air is at an angle and a velocity sufficient to carry acceptable weight materials upwardly to a collection point, while overweight material falls through the chute to a separate collection point.

The apparatus for accomplishing this result comprises a collection hopper, an inclined chute, an inclined air blower, and a discharge chute for acceptable materials.

BRIEF DESCRIPTION OF THE DRAWINGS

The method and apparatus of the present invention will be more fully described with reference to the drawings in which.

DETAILED DESCRIPTION OF THE PREFERRED EMBODIMENTS

Figure 1:
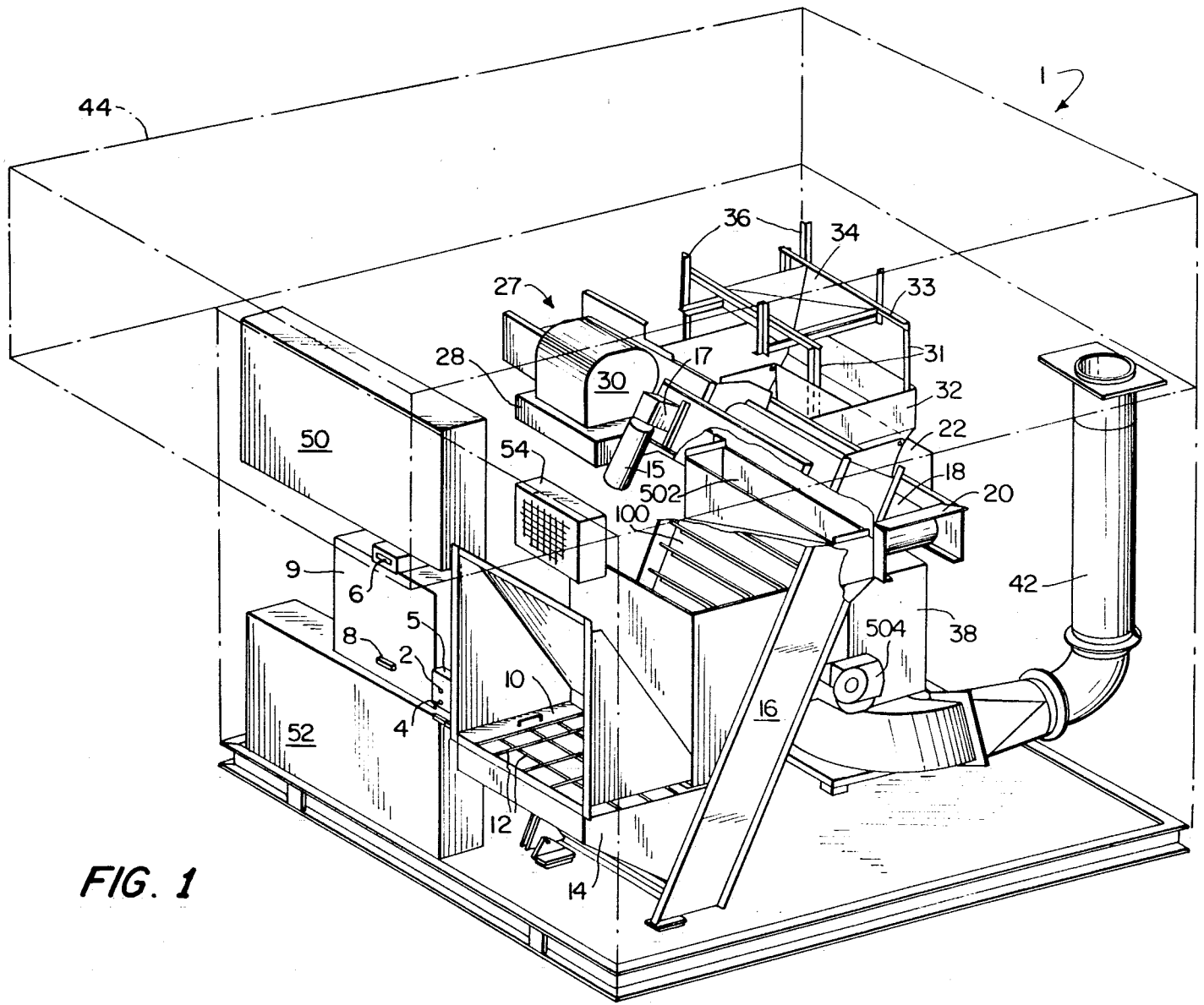
FIG. 1 is a perspective view of a reverse vending machine, including the metallic material separation system of the present invention, with the outer walls thereof in phantom.
Figure 2:
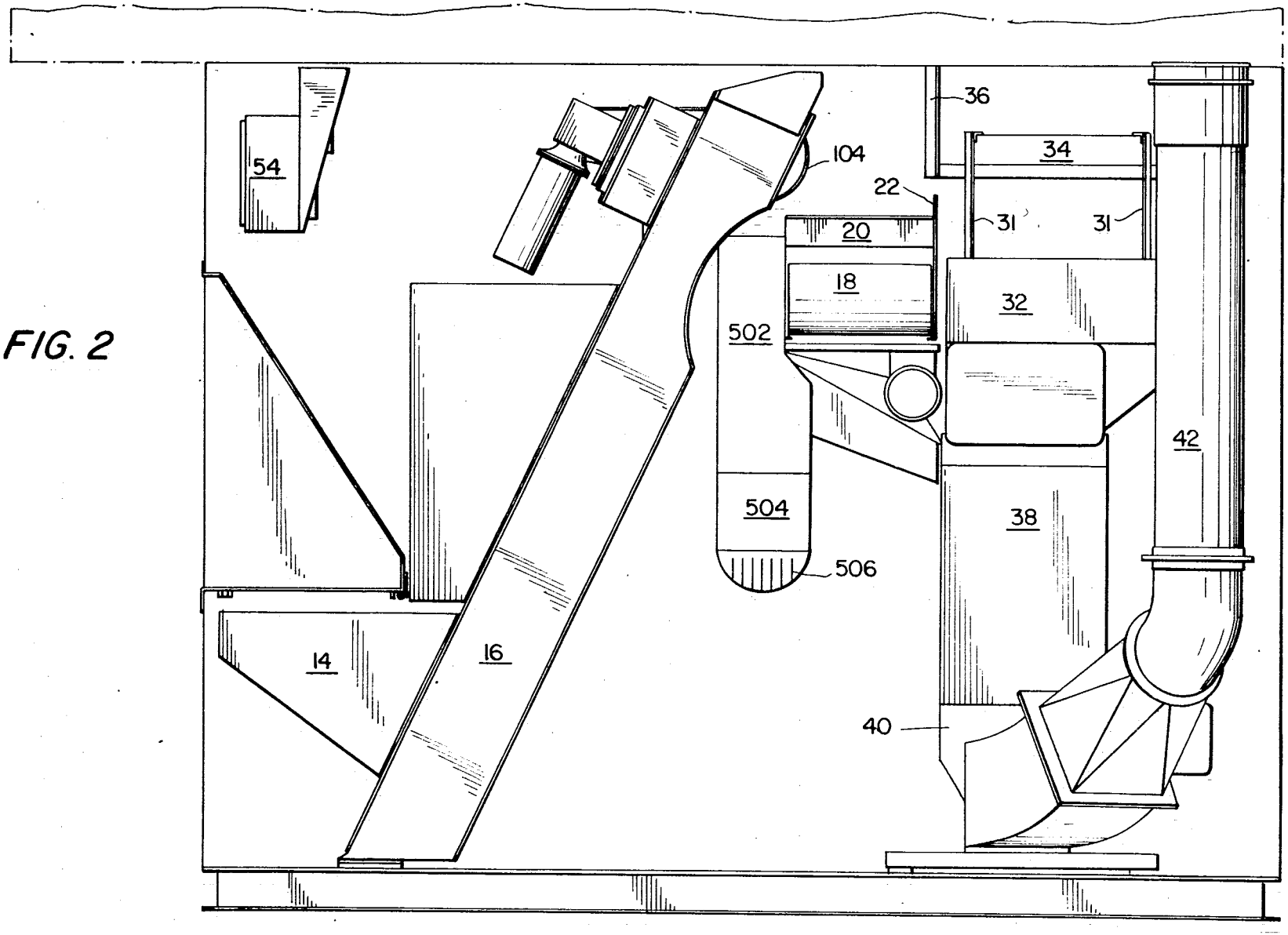
FIG. 2 is a right side view of the revese vending machine with the outer walls in phantom.
Figure 3:
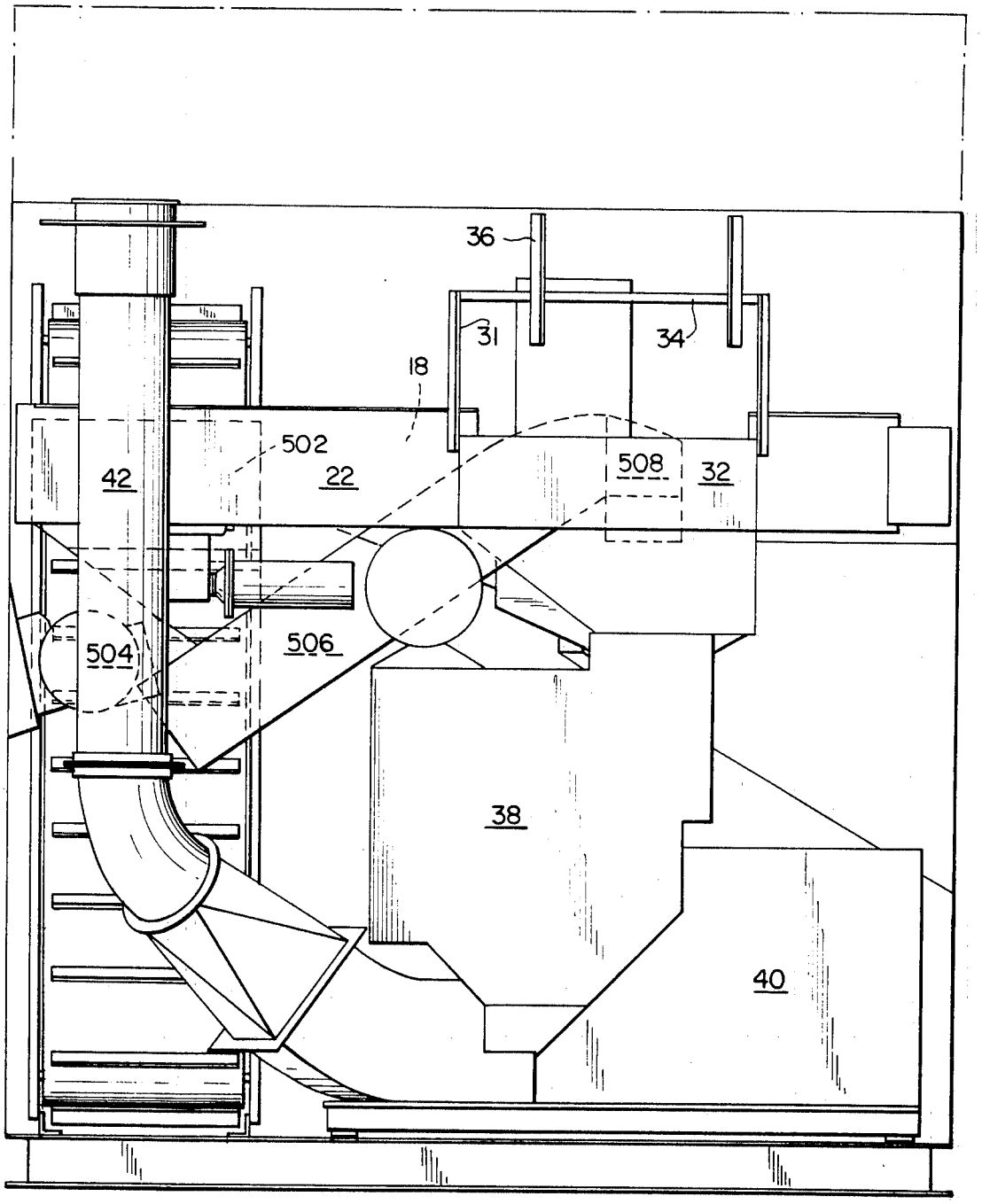
FIG. 3 is a back view of the reverse vending machine with the outer walls in phantom.
Figure 4:
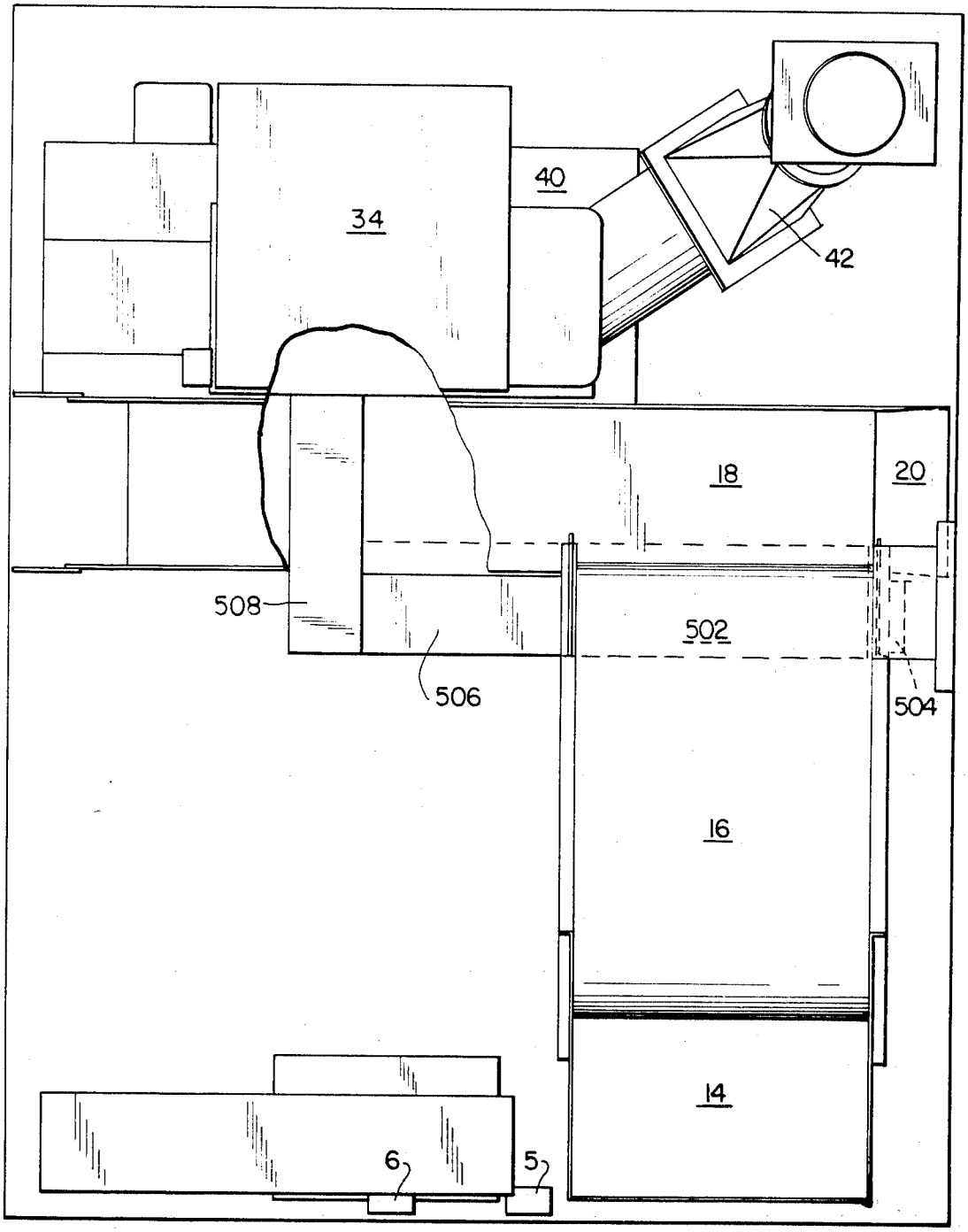
FIG. 4 is a top view of the reverse vending machine with the storage bin removed.

Turning now to the FIGURES, and especially FIGS. 1 through 4, the passage of material through a reverse vending machine including the metallic material separation system of the present invention will be described. Upon arrival at the reverse vending machine 1, a customer opens door 10 by sliding it from its closed position to its open position, as illustrated. The customer then dumps the material to be handled by the machine 1 into entry hopper 14. Entry hopper 14 is protected by shield 12, which is a grid formed from rods, bars and the like. This shield 12 helps protect the machine 1 from inordinately large materials, such as castings, extrusions, or the like. Clearly, however, the shield 12 cannot protect the machine 1 from every foreign object which may be fed to the system. Thus, other protective mechanisms will be described below.

After filling hopper 14 to its capacity, or having run out of material to feed to the machine 1, the customer closes door 10 and pushes start button 2, beginning operation of the machine 1. A signal light 4 may indicate beginning of operation of the system 1. Start button 2 signal light 4 are held within panel 5. An alphanumeric display box 6 may update the customer as to the status of the operation throughout the processing. Thus, this box 6, which is microprocessor controlled, as is the entire system, may indicate that the machine is ready for operation, is out of service, is processing the material, and may indicate the amount of payout to be made.

The material for processing is transferred from input hopper 14 by means of input conveyor 16. A shield (not shown) captures any material which may fall back from conveyor 16, so that this material is again caught up by the conveyor 16 for processing. At the discharge end of conveyor 16, a magnetic head pulley 104 captures all magnetic materials, such as steel cans and other ferromagnetic materials, causing these materials to be held onto belt 100 until belt 100 passes from magnetic head pulley 104. This causes any magnetic materials to fall into hopper 502, where they are further processed by mechanism 500, as will be described below with reference to FIG. 5.

Non-magnetic materials exit belt 100 onto conveyor 18. These materials are carried by conveyor belt 18 over a linear induction motor mechanism 27, including a blower 30 for cooling and an enclosure 28 within which a linear induction motor is mounted. Baffles 20 and 22 are positioned at the beginning of conveyor 18, to prevent materials exiting conveyor belt 100 from falling from the system. Belt 18 may be unsupported along its length corresponding to the width of conveyor 16. This also aids in preventing materials from bouncing off of conveyor 18.

As the material passes over linear induction motor 27, conductive materials, such as aluminum cans, will be deflected by the linear induction motor 22 into a weigh hopper 32. Optionally and preferably, the linear induction motor 27 could deflect the conductive materials into another hopper 502 (not shown), similar to hopper 502 as previously described, for processing as will be described below with reference to FIG. 5 before passing these materials to weigh hopper 32. Nonconductive materials, such as paper, sticks and the like, as well as some overweight conductive materials, are not deflected by linear induction motor 27 and pass off the end of conveyor 18 to be collected as waste.

Once all material has reached hooper 32, the weight of hopper 32 and its contents is determined. Hopper 32 is mounted by means of rails 31 and cross rails 33 to a scale mechanism 34, which is in turn hung from the ceiling of the machine 1 by means of rails 36. The weight of the material within hopper 32 is determined, with this signal being relayed to a microprocessor controlled coin vault 9, where the consumer is paid based on a pre-determined amount per unit weight through pay out slot 8 with the amount being displayed on alphanumeric display box 6.

The cans in weigh hopper 32 are then permitted to enter can crusher 38, by opening a bottom door on weigh hopper 32. The cans are crushed, and conveyed by means of blower 40 through chute 42 into storage bin 44. As will readily be realized, both steel cans from chute 508 and aluminum cans from weigh scale 32 are combined during the crushing, blowing and storage operations.

This is in contrast to prior systems, where steel materials were separated and held separately. In the prior systems, storage facilities were necessary for the steel materials, and, due to the nature of such systems, this storage was small relative to that for aluminum cans. Unfortunately, the small steel storage necessitated service at more frequent intervals than would be desired.

Alternatively, the chute 508 for steel cans could be directed upwardly, and connected to storage bin 44. In this case, the steel cans would be blown directly into bin 44 without crushing, bypassing crusher 38.

Cans collected by reverse vending machines are normally transported to a permanent recycling facility. At such facilities, magnetic separators are routinely employed to separate steel from aluminum, in the same way they are separated for customers bringing cans directly to the center. Thus, isolation of steel at the reverse vending machine is unnecessary. The reverse vending machine 1 of the present invention recombines steel and aluminum cans in a single storage bin 44 on top of the reverse vending machine 1, after having previously separated these materials for weighing of the aluminum cans.

As previously mentioned, the reverse vending machine 1 is microprocessor controlled. The various wiring and circuitry necessary to operate the system are contained within cabinets 50 and 52 and are conventional to those of ordinary skill in the microprocessor field. An air conditioner 54 is provided for cooling of the components.

Thus far, the general operation of the reverse vending machine 1 has been described. The metallic separation system of the present invention will now be more fully described with reference to FIG. 5.

Figure 5:
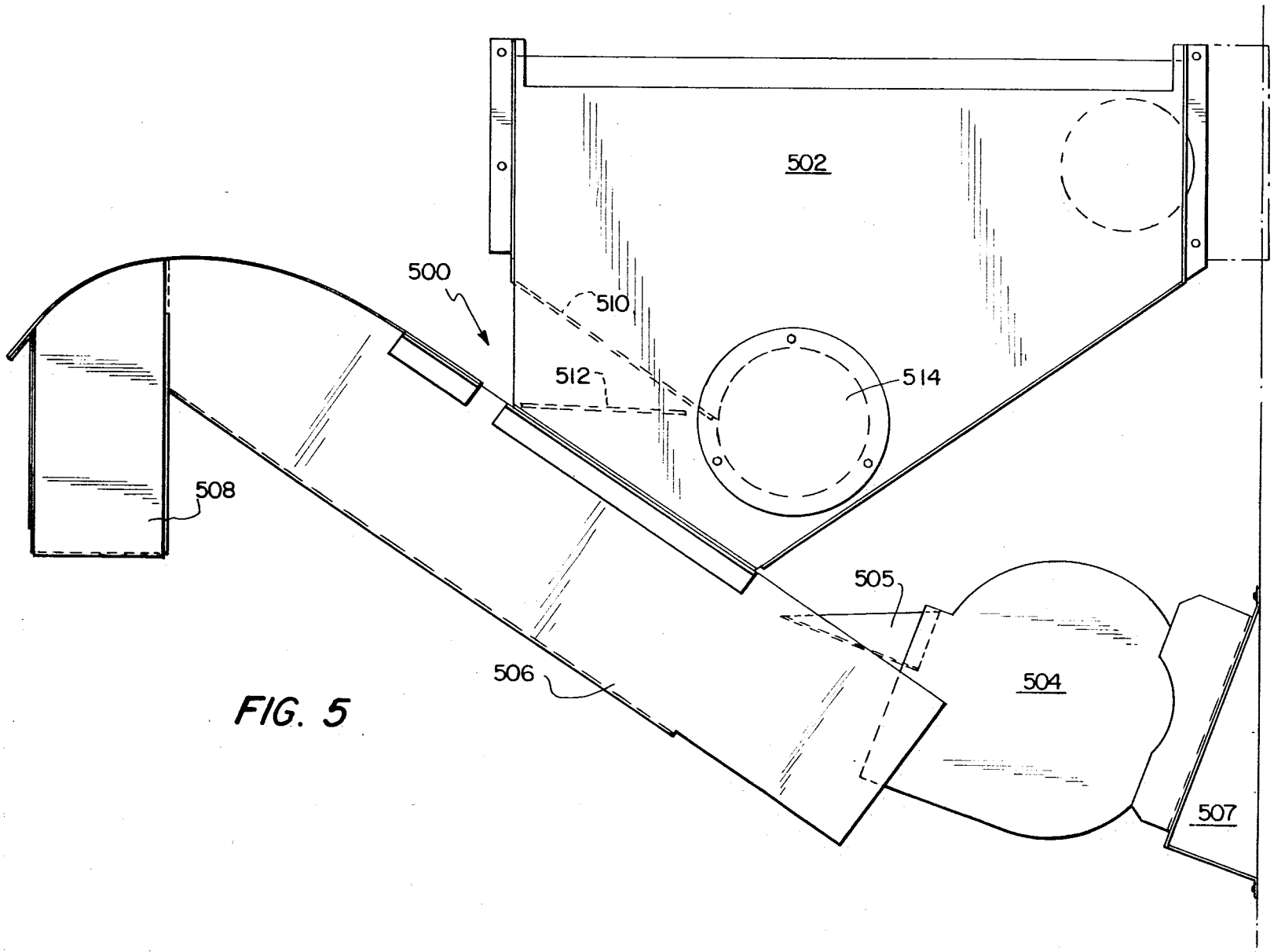
FIG. 5 is a side elevational view of the metallic material separation system of the present invention.

Turning to FIG. 5, the metallic material separation 500 is shown. Whether the metallic input is magnetic material coming from input conveyor 16, as illustrated in FIG. 1, or non-magnetic conductive material from deflection by linear induction motor 27 prior to weight hopper 32 (not shown), the metallic material passes into a hopper 502. Hopper 502 may be oriented either parallel or perpendicular to its input mechanism. Hopper 502 includes baffle 510 and connecting member 512 to guide the magnetic material from hopper 502 into chute 506. A removable access port 514 may be provided in hopper 502 to facilitate cleaning and unjamming of hopper 502, should exceptionally large materials be acquired herein.

The metallic materials are passed from hopper 502 into chute 506. Chute 506 is positioned at an incline with respect to the horizontal. The angle of incline of chute 506 may range from about 25° to 60°. At one end of chute 506 is an air blower 504, which is mounted by means of bracket 507 to provide an airflow into chute 506 at an angle with respect to the horizontal. The angle of airflow into chute 506 may range from about 12° to 32°, and is less than the angle of the chute 506 for a given system. A baffle 505 aids in directing the air flow.

By adjusting the angles of chute 506 and air blower 504, as well as the air flow rate from blower 504, which may range from about 1100 to 1700 cubic feet per minute, the system 500 may be tuned to blow materials less than and up to a given buoyancy upwardly through chute 506 and into chute 508, from where the materials thus blown may pass to can crusher 38 or to storage bin 44, in the case of steel materials, as previously described, or, in the case of aluminum materials, to weight hopper 32.

Those materials which are less buoyant than those which can be blown upwardly by the airflow from blower 504 pass downwardly through chute 506, and, due to the relative angles of chute 506 and air blower 504, pass below blower 504 and fall into a suitable collection device (not shown).

As is readily apparent, the system of the present invention is not designed to be the main separation mechanism for the aluminum from the balance of the waste input, as in such systems as in U.S. Pat. No. 4,179,018. However, this auxilliary system does permit separation of permissible buoyant metallic materials from either the aluminum or the magnetic material streams.

From the foregoing, it is clear that the method and apparatus of the present invention provides solution to the heavy metallic material problem which has been encountered in prior known reverse vending machines.

While the method and apparatus of the present invention have been described with reference to certain specific embodiments thereof, it is not intended to be so limited thereby, except as set forth in the accompanying claims.

We claim:

1. In a method for recycling conductive material from a material input comprising separating magnetic material from said material input, separating said conductive material from the balance of said material input and recombining said magnetic material and said conductive material the improvement comprising separating overweight magnetic material from said magnetic material and/or overweight conductive material from said conductive material and recombining either the remainder of said magnetic material and said conductive material, the remainder of said conductive material and said magnetic material or the remainders of said magnetic material and said conductive material.

2. The method of claim 1 wherein said separating of overweight magnetic material and/or overweight conductive material comprises air separation.

3. The method of claim 2 wherein said air separation of said magnetic material and of said conductive material each comprises passing said magnetic material or said conductive material downwardly along a chute, said chute being positioned at a first angle with respect to the horizontal, blowing air upwardly into said chute at a second angle with respect to the horizontal, said second angle being less than said first angle, collecting overweight magnetic material or conductive material from the bottom of said chute and recombining the remainder of said magnetic material or said conductive material from the top of said chute.

4. The method of claim 3 wherein said first angle is between about 25° to 60° and said second angle is between about 12° to 32°.

5. The method of claim 1 wherein said conductive material is crushed prior to said recombining.

6. The method of claim 5 wherein said magnetic material is crushed prior to said recombining.

7. The method of claim 5 wherein said magnetic material is not crushed prior to said recombining.

8. In an apparatus for recycling conductive material from a material input including means for separating magnetic material from said material input, means for separating said conductive material from the remainder of said material input and means for recombining said magnetic material and said conductive material the improvement comprising means for separating overweight magnetic material from said magnetic material or overweight conductive material from said conductive material and for recombining the remainder of said magnetic material with said conductive material or the remainder of said conductive material with said magnetic material, said means for separating overweight magnetic material or overweight conductive material comprising a chute positioned at a first angle with respect to the horizontal, said chute being open at both ends thereof and having an input location along the length thereof, air blower means positioned to direct air upwardly into said chute at a second angle with respect to the horizontal, said second angle being less than said first angle, means to collect properly buoyant magnetic material or conductive material at the upper end of said chute and means to collect overweight magnetic material or conductive material at the lower end of said chute.

9. The apparatus of claim 8 further comprising an input hopper connected at said input location.

10. The apparatus of claim 8 wherein said air blower means includes a baffle means for air direction control.

11. The apparatus of claim 8 wherein said means to collect properly buoyant magnetic material or conductive material comprises a second chute.

12. The apparatus of claim 11 wherein said second chute is connected to a storage bin.

13. The apparatus of claim 11 wherein said second chute is connected to a can crusher.

14. The apparatus of claim 8 wherein said means to collect overweight magnetic material or conductive material comprises a container

15. The apparatus of claim 8 wherein said chute is positioned at an angle between about 25° to 60°.

16. The apparatus of claim 15 wherein said air blower is positioned to direct air at an angle between about 12° to 32°.

17. The apparatus of claim 8 further comprising a second means for separating overweight magnetic material or overweight conductive material, one of said means for separating overweight material acting upon said magnetic material and the other of said means for separating overweight material acting upon said conductive material, and wherein said means for recombining recombines the remainder of said magnetic material and the remainder of said conductive material.

* * * * *